US006027249A

United States Patent [19]

Bielinski

[11] Patent Number: 6,027,249

[45] Date of Patent: Feb. 22, 2000

[54] ICE COOLER JACKET

[76] Inventor: George H. Bielinski, 7215 Slayton Rd., Flagstaff, Ariz. 86004-1354

[21] Appl. No.: 09/229,050

[22] Filed: Jan. 11, 1999

[51] Int. Cl.[7] ..... B65D 30/14

[52] U.S. Cl. ..... 383/110; 383/66; 150/156

[58] Field of Search ..... 383/66, 110; 150/156

[56] References Cited

U.S. PATENT DOCUMENTS

| | | | |
|---|---|---|---|
| 166,110 | 7/1875 | Jones | 62/371 |
| 1,869,756 | 8/1932 | Kinard | 383/110 X |
| 1,895,278 | 1/1933 | Crawford | 383/110 X |
| 1,971,395 | 8/1934 | Danner | 383/110 X |
| 2,808,093 | 10/1957 | Gilman | 383/110 X |
| 3,443,397 | 5/1969 | Donovan et al. | 62/398 |
| 4,759,467 | 7/1988 | Byrne | 220/495.08 |
| 5,251,460 | 10/1993 | DeMarco et al. | 62/371 |
| 5,351,494 | 10/1994 | Jensen et al. | 62/60 |
| 5,857,778 | 1/1999 | Ells | 383/110 X |

*Primary Examiner*—Jes F. Pascua

[57] ABSTRACT

An ice cooler jacket system including a one-piece composite material formed with an interior flexible fabric and an exterior flexible fabric and with thermal insulation material therebetween. The composite material includes a plurality of panels. A central rectangular back panel is provided with two long edges and two short edges sized to fit over the back of a cooler. A generally rectangular top panel is integrally formed with one long edge of the back panel to fit over the top of the cooler. A bottom panel is integrally formed with the other long edge of the back panel with two trapezoidal panels extending outwardly from the bottom panel with rectangular apertures adjacent to the central extent thereof for the passage of a drain tube of the cooler. Also provided is a first small left side panel integrally formed with the back panel in a generally rectangular configuration and extending laterally in a first direction from one short side of the back panel configured in a shape to conform to the left side of the cooler a second small right side panel integrally formed with the back panel in a generally rectangular configuration including an interior region sized to correspond to the right side of a cooler with a slot therethrough for the passage of a cooler handle. The second lateral panel includes an enlarged rectangular region corresponding in size to the front of the cooler.

6 Claims, 3 Drawing Sheets

14
16
20
43
74
41
66
68
76
80
70
4
4
36
38
40
32
48
50
45
28
24
22
58
60
30
26
44
50
48

ICE COOLER JACKET

BACKGROUND OF THE INVENTION

1. Field of the Invention

The present invention relates to an ice cooler jacket and more particularly pertains to extending the length of time that contents may remain cool in a cooler or ice chest.

2. Description of the Prior Art

The use of coolers and ice chests and similar containers of known designs and configuration is known in the prior art. More specifically, coolers and ice chests and similar containers of known designs and configuration heretofore devised and utilized for the purpose of increasing the efficiency of coolers and ice chests through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,251,460 to DeMarco et al. discloses a Cooler Cover for Beverage Kegs. U.S. Pat. No. 5,351,494 to Jensen et al. discloses a Cooler Chest Insulative Blanket. U.S. Pat. No. 3,443,397 to Donovan et al. discloses a Barrel Cooler. European Patent Application 157 751 to Lejondahl discloses a Thermally Insulated Container. International Application Number PCT/US95/02785 to Douer discloses an Insulated Bag and Accessories for Cooling Bottled Beverages. U.S. Pat. No. 4,759,467 to Byrne discloses a Disposable Cooler Liner. Lastly, U.S. Pat. No. 166,110 to Jones discloses a Removable Refrigerator for Pails.

While these devices fulfill their respective, particular objectives and requirements, the aforementioned patents do not describe ice cooler jacket as disclosed herein.

In this respect, the ice cooler jacket according to the present invention substantially departs from the conventional concepts and designs of the prior art, and in doing so provides an apparatus primarily developed for the purpose of extending the length of time that contents may remain cool in a cooler or ice chest.

Therefore, it can be appreciated that there exists a continuing need for a new and improved ice cooler jacket which can be used for extending the length of time that contents may remain cool in a cooler or ice chest. In this regard, the present invention substantially fulfills this need.

SUMMARY OF THE INVENTION

In view of the foregoing disadvantages inherent in the known types of coolers and ice chests and similar containers of known designs and configuration now present in the prior art, the present invention provides an improved ice cooler jacket. As such, the general purpose of the present invention, which will be described subsequently in greater detail, is to provide a new and improved ice cooler jacket and method which has all the advantages of the prior art and none of the disadvantages.

To attain this, the present invention essentially comprises a new and improved ice cooler jacket system with insulating capabilities to fit over a cooler or ice chest to extend the length of time that the contents can remain cool. The system comprises a one-piece composite material formed with an interior flexible fabric and an exterior flexible fabric and with thermal insulation material therebetween. The composite material includes a plurality of panels. A central rectangular back panel with two long edges and two short edges is sized to fit over the back of a cooler. A generally rectangular top panel is integrally formed with one long edge of the back panel to fit over the top of the cooler. The edge of the top panel remote from the back panel includes an exterior first strip of a pile-type fastener. A bottom panel is integrally formed with the other long edge of the back panel with a complimentary strip of a second pile-type fastener on the edge thereof remote from the back panel and with two generally trapezoidal panels extending outwardly from the bottom panel with rectangular apertures adjacent to the central extent thereof for the passage of a drain tube of the cooler. A first small left side panel is integrally formed with the back panel in a generally rectangular configuration and extending laterally in a first direction from one short side of the back panel configured in a size and shape to conform to the left side of a cooler with a third strip of a pile-type fastener on the rear face thereof and edge thereof remote from the back panel and with a slot formed therethrough for passage of one handle of the cooler. A second small right side panel is integrally formed with the back panel in a generally rectangular configuration and extending laterally in a second direction from the other short side of the back panel and including an interior region sized to correspond to the right side of a cooler with a slot therethrough for the passage of a cooler handle and the second lateral panel includes an enlarged rectangular region corresponding in size and shape to the front of the cooler with a fourth strip of a pile-type fastener on the front face thereof remote from the back panel adapted to cooperate with the third pile-type fastener. Also provided is an intermediate strip of a fifth pile-type fastener on the front of the second component for contacting the central front face of the cooler or ice chest.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ice cooler jacket which has all of the advantages of the prior art coolers and ice chests and similar containers of known designs and configuration and none of the disadvantages.

It is another object of the present invention to provide a new and improved ice cooler jacket which may be easily and efficiently manufactured and marketed.

It is further object of the present invention to provide a new and improved ice cooler jacket which is of durable and reliable constructions.

An even further object of the present invention is to provide a new and improved ice cooler jacket which is susceptible of a low cost of manufacture with regard to both materials and labor, and which accordingly is then susceptible of low prices of sale to the consuming public, thereby making such ice cooler jacket economically available to the buying public.

Even still another object of the present invention is to provide a ice cooler jacket for extending the length of time that contents may remain cool in a cooler or ice chest.

Lastly, it is an object of the present invention to provide a new and improved ice cooler jacket system including a one-piece composite material formed with an interior flexible fabric and an exterior flexible fabric and with thermal insulation material therebetween. The composite material includes a plurality of panels. A central rectangular back panel is provided with two long edges and two short edges sized to fit over the back of a cooler. A generally rectangular top panel is integrally formed with one long edge of the back panel to fit over the top of the cooler. A bottom panel is integrally formed with the other long edge of the back panel with two trapezoidal panels extending outwardly from the bottom panel with rectangular apertures adjacent to the central extent thereof for the passage of a drain tube of the cooler. Also provided is a first small left side panel integrally formed with the back panel in a generally rectangular configuration and extending laterally in a first direction from one short side of the back panel configured in a shape to conform to the left side of the cooler a second small right side panel integrally formed with the back panel in a generally rectangular configuration including an interior region sized to correspond to the right side of a cooler with a slot therethrough for the passage of a cooler handle. The second lateral panel includes an enlarged rectangular region corresponding in size to the front of the cooler.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
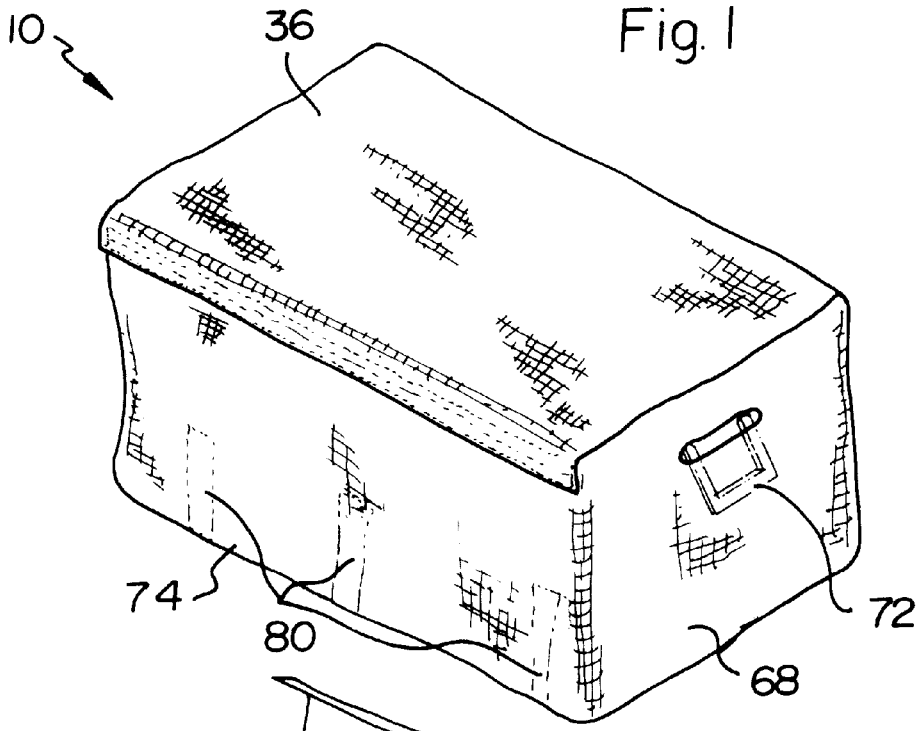
FIG. 1 is a perspective view of the preferred embodiment of the ice cooler jacket constructed in accordance with the principles of the present invention.
Figure 2:
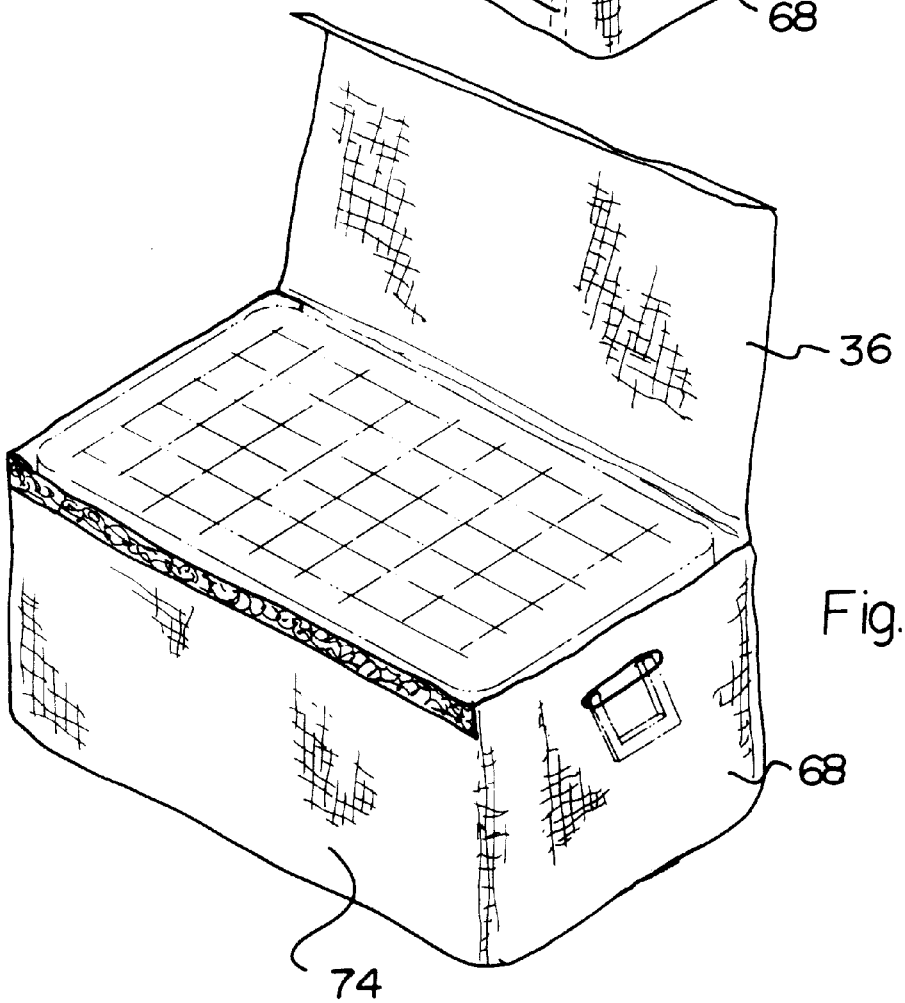
FIG. 2 is a perspective illustration similar to FIG. 1 but with the top in an open orientation.
Figures 3, 4:
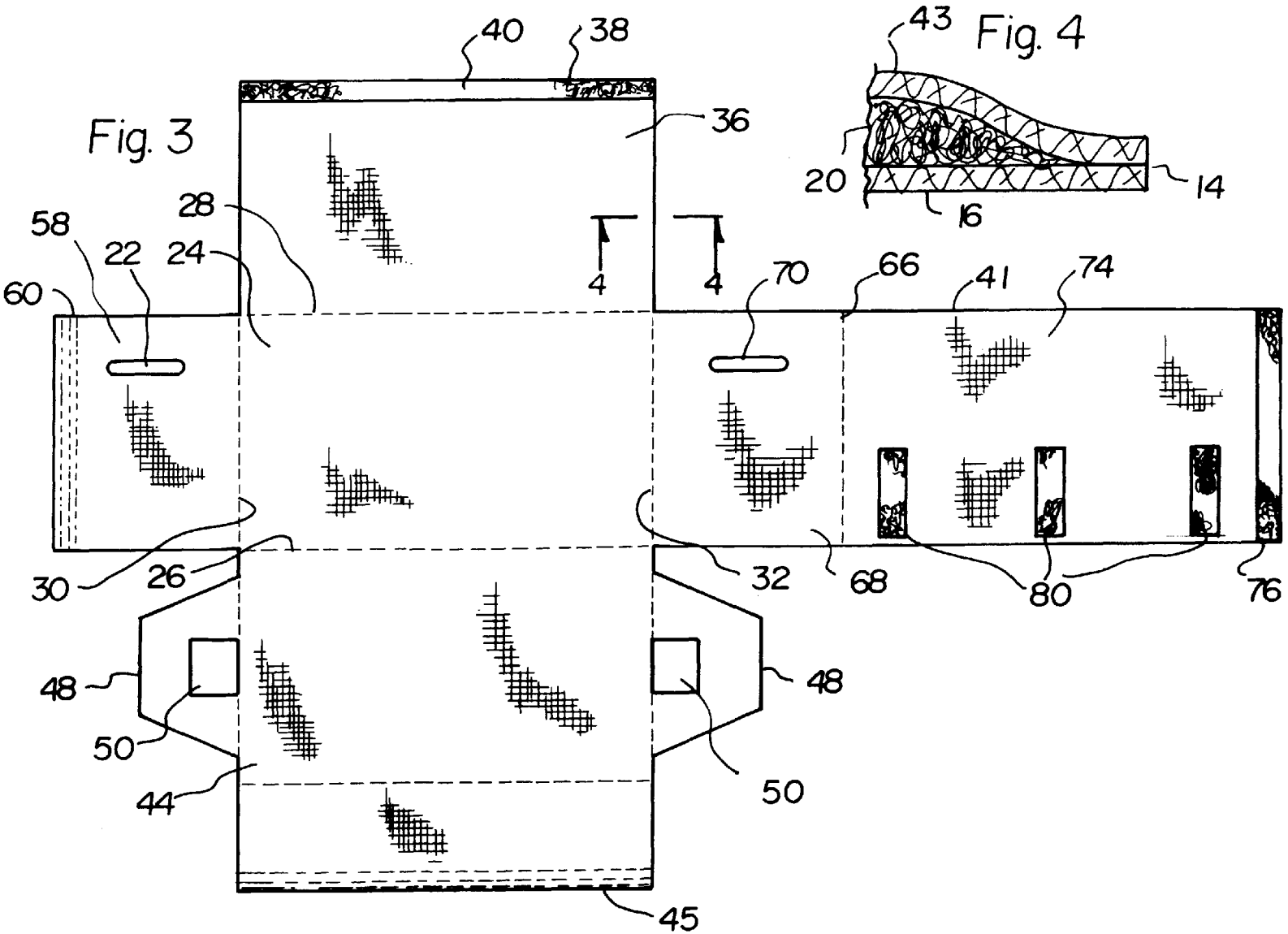
FIG. 3 is a top elevational view of the ice cooler jacket but shown in a flat orientation prior to deployment.
FIG. 4 is a perspective illustration of an alternate embodiment of the invention.

With reference now to the drawings, and in particular to FIG. 1 thereof, the preferred embodiment of the new and improved ice cooler jacket embodying the principles and concepts of the present invention and generally designated by the reference numeral 10 will be described.

The present invention, the ice cooler jacket 10 is comprised of a plurality of components. Such components in their broadest context include a one-piece composite material, a top panel, a bottom panel, a left side panel, a right side panel and an intermediate strip. Such components are individually configured and correlated with respect to each other so as to attain the desired objective.

The new and improved ice cooler jacket system 10 with insulating capabilities functions to fit over a cooler or ice chest. This extends the length of time that the contents can remain cool comprises, in combination, a one-piece composite material 14. The composite material is formed with an interior flexible fabric 16 and an exterior flexible fabric 18. The one-piece composite material also has with thermal insulation material 20 therebetween. The composite material additionally includes a plurality of panels.

Also included in the system is a central rectangular back panel 24. Such back panel has two long edges 26, 28 and two short edges 30, 32. The panels edges are sized to fit over the back of a cooler.

Additionally provided is a generally rectangular top panel 36. Such panel is integrally formed with one long edge of the back panel to fit over the top of the cooler. The edge 38 of the top panel remote from the back panel includes an exterior first strip of a pile-type fastener 40, as for example Velcro.

Further included in the system is a bottom panel 44. Such panel is integrally formed with the other long edge of the back panel. it includes a complimentary strip of a second pile-type fastener 46. Such fastener is on the edge thereof remote from the back panel. It also includes two trapezoidal panels 48. Such panels extend outwardly from the bottom panel. They are formed with rectangular apertures 50 adjacent to the central extent thereof. The apertures are for the passage of a drain tube 52 of the cooler 54.

A first small left side panel 58 is next integrally formed with the back panel. It is in a generally rectangular configuration. The left side panel extends laterally in a first direction from one short side of the back panel. It is configured in a shape and size to conform to the left side of the cooler with a third strip of a pile-type fastener 60. Such fastener is on the rear face at the edge thereof remote from the back panel. It is formed with a slot 62 therethrough for passage of one handle of a cooler.

Also provided is a second small right side panel 66 which is integrally formed with the back panel in a generally rectangular configuration. It extends laterally in a second direction from the other short side of the back panel and includes an interior region 68 sized and shaped to correspond to the right side of a cooler. It has a slot 70 therethrough for the passage of a cooler handle 72. The second lateral panel includes an enlarged rectangular region 74. Such region corresponds in size and shape to the front of a cooler. It has with a fourth strip of a pile-type fastener 76 on the front face thereof remote from the back panel. Such fastener is adapted to cooperate with the third pile-type fastener.

Lastly provided is an intermediate strip of a fifth pile-type fastener 80 on the front of the second component. Such fastener is for contacting the central front face of the cooler or ice chest.

Figure 5:
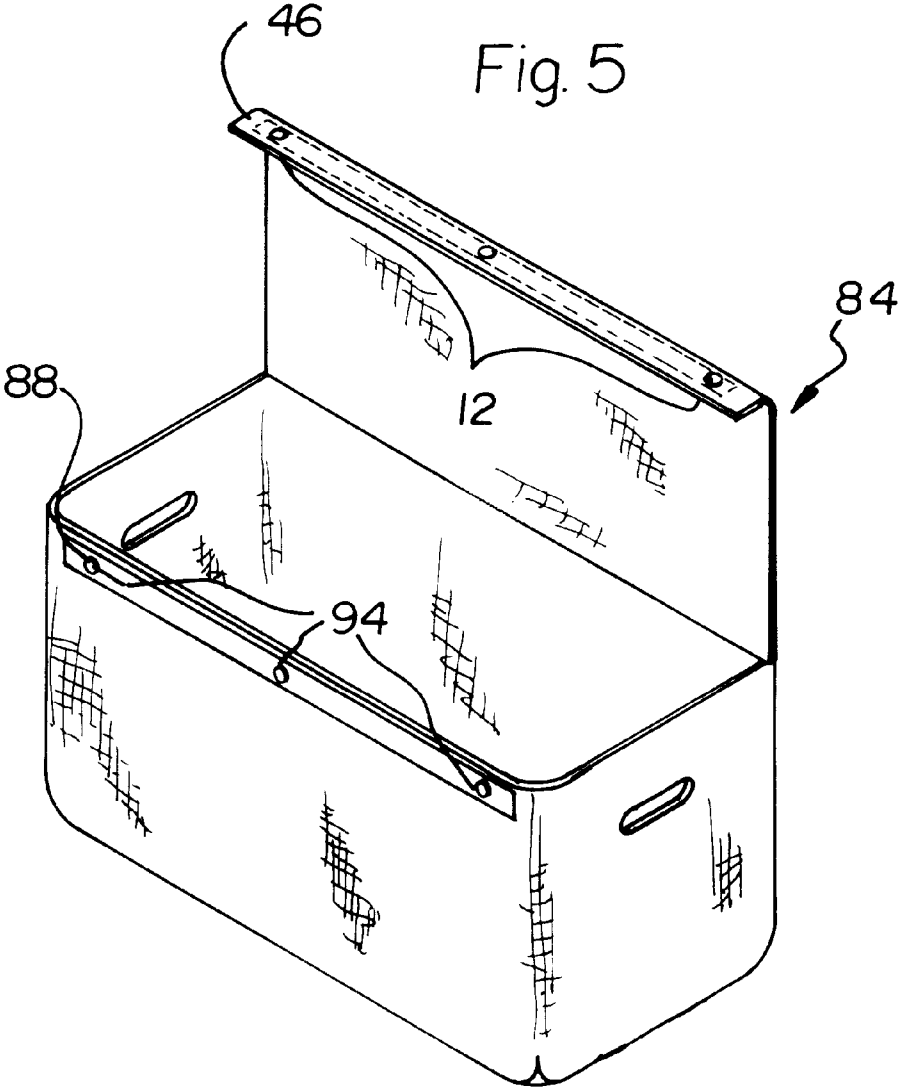

The embodiment of FIG. 5 is a system 84 similar to that of the embodiment of FIGS. 1–4 except that no pile-type fasteners are employed except for fasteners 86, 88 for opening and closing the top. The top and bottom and side panels are integrally formed with the back panel.

Figure 6:
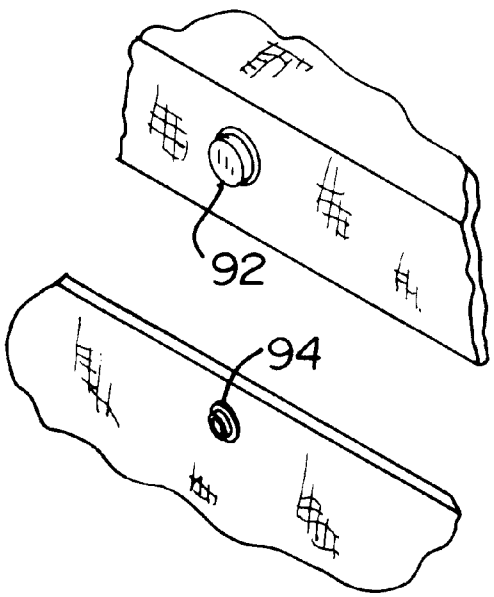
FIGS. 5 and 6 are a further alternate embodiment illustrating snaps rather than a pile-type fastener for closure purposes.

Lastly, the embodiment of FIG. 6 employs snaps 92, 94 on the front panel and top panel for opening and closing the top.

The ice cooler jacket of the preset invention is an insulated cover designed to fit over a cooler or ice chest that will extend the length of time that the contents can remain cool.

The present invention is fabric-based, and is designed to be wrapped around the cooler and secured in position with pile-type fasteners. The construction of the jacket includes a layer of high-quality flexible insulating material and a durable cover which is of a reflective color.

To use the device, the jacket is first spread out on a flat surface. The cooler is centered on the bottom panel and then the side panels and end panels are lifted up and secured together via the provided pile-type strips and panels.

The end panels of the jacket have slots to allow the user to grasp the existing handles of the cooler. These slots could have covering flaps to help retain the insulating qualities when the handles are not in use. There is also an opening to accommodate a drain valve on the cooler.

The cooler jacket of the present invention could be offered in a selection of sizes, and in a variety of colors or patterns. One size will fit a range of cooler sizes, because of the adjustability of wrap-around design.

The cooler jacket is suitable for imprint with advertising or promotional messages such as licensed sports teams logos.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An ice cooler jacket system comprising:

a one-piece composite material formed with an interior flexible fabric, an exterior flexible fabric and with thermal insulation material therebetween, the composite material including a plurality of panels;

a central rectangular back panel with two long edges and two short edges sized to fit over the back of a cooler;

a generally rectangular top panel integrally formed with one long edge of the back panel to fit over the top of the cooler;

a bottom panel integrally formed with the other long edge of the back panel with two trapezoidal panels extending outwardly from the bottom panel with rectangular apertures adjacent to the central extent thereof for the passage of a drain tube of the cooler;

a first small left side panel integrally formed with the back panel in a generally rectangular configuration and extending laterally in a first direction from one short side of the back panel configured in a shape to conform to the left side of the cooler; and a second small right side panel integrally formed with the back panel in a generally rectangular configuration including an interior region sized to correspond to the right side of a cooler with a slot therethrough for the passage of a cooler handle, the second lateral panel including an enlarged rectangular region corresponding in size to the front of the cooler.

2. The system as set forth in claim 1 and further comprising a fastener on the front of the second component and the central front panel for opening and closing the system.

3. The system as set forth in claim 1 and further including a plurality of strips of a pile-type fastener on the panels remote from the back panel.

4. The system as set forth in claim 1 wherein the top and bottom and side panels are integrally formed with the back panel.

5. The system as set forth in claim 1 wherein the top panel and front panel include a snap fastener.

6. A ice cooler jacket system with insulating capabilities to fit over a cooler or ice chest to extend the length of time that the contents can remain cool comprising, in combination:

a one-piece composite material formed with an interior flexible fabric, an exterior flexible fabric and with thermal insulation material therebetween, the composite material including a plurality of panels;

a central rectangular back panel with two long edges and two short edges sized to fit over the back of a cooler;

a generally rectangular top panel integrally formed with one long edge of the back panel to fit over the top of the cooler, the edge of the top panel remote from the back panel including an exterior first strip of a pile-type fastener;

a bottom panel integrally formed with the other long edge of the back panel with a complimentary strip of a second pile-type fastener on the edge thereof remote from the back panel and with two generally trapezoidal panels extending outwardly from the bottom panel with rectangular apertures adjacent to the central extent thereof for the passage of a drain tube of the cooler;

a first small left side panel integrally formed with the back panel in a generally rectangular configuration and extending laterally in a first direction from one short side of the back panel configured in a size and shape to conform to the left side of a cooler with a third strip of a pile-type fastener on the rear face thereof and on the edge thereof remote from the back panel and with a slot formed therethrough for passage of a handle of the cooler;

a second small right side panel integrally formed with the back panel in a generally rectangular configuration and extending laterally in a second direction from the other short side of the back panel and including an interior region sized to correspond to the right side of a cooler with a slot therethrough for the passage of a cooler handle, the second lateral panel including an enlarged rectangular region corresponding in size and shape to the front of the cooler with a fourth strip of a pile-type fastener on the front face thereof remote from the back panel adapted to cooperate with the third pile-type fastener; and an intermediate strip of a fifth pile-type fastener on the front of the second component for contacting the central front face of the cooler or ice chest.

* * * * *